US007770947B2

(12) United States Patent
Huang

(10) Patent No.: US 7,770,947 B2
(45) Date of Patent: Aug. 10, 2010

(54) ELECTROMAGNETIC LOCK

(75) Inventor: Chien-Ying Huang, Taichung (TW)

(73) Assignee: Soca Technology Co., Ltd., Taichung ( * ) Notice: Subject to any disclaimer, the term of this patent is extended or adjusted under 35 U.S.C. 154(b) by 165 days.

(21) Appl. No.: 12/050,962

(22) Filed: Mar. 19, 2008

(65) Prior Publication Data

US 2009/0235702 A1 Sep. 24, 2009

(51) Int. Cl.
*E05C 19/16* (2006.01)

(52) U.S. Cl. ..... 292/251.5; 292/341.16

(58) Field of Classification Search ..... 292/251.5, 292/341.16, 144, 92, DIG. 62; 24/303
See application file for complete search history.

(56) References Cited

U.S. PATENT DOCUMENTS 5,184,856 A * 2/1993 Waltz ..... 292/251.5
6,135,515 A * 10/2000 Roth et al. ..... 292/251.5
6,722,715 B1 * 4/2004 Chiang ..... 292/251.5

* cited by examiner

*Primary Examiner*—Peter M. Cuomo
*Assistant Examiner*—Mark Williams

(57) ABSTRACT

An electromagnetic lock comprises: a body combined with a retaining frame by using locking studs and retaining screws; one side of the retaining frame being installed with a trigger receiving box; and an absorption plate combined to a supporting frame; two metal rings being installed in the absorption plate; the absorption plate having locking screws; wherein in installation, for aligning the body and the absorption plate, adjusting screws are installed between the absorption plate and the supporting frame. The supporting frame has screw holes for receiving the adjusting screws; one side of the supporting frame has two magnetic holes for receiving magnets; a magnet protection sheet are installed at lower side of the magnets; and a small screw serves to lock the protection sheet to the supporting frame. The trigger can be hidden so as to occupy a small space and the installation work is easy.

8 Claims, 6 Drawing Sheets

ELECTROMAGNETIC LOCK

FIELD OF THE INVENTION

The present invention relates to electromagnetic locks, and particularly to an electromagnetic lock, which can be aligned easily in installation, and has less noise and occupies a small space.

BACKGROUND OF THE INVENTION

The prior art electromagnetic lock has a first seat embedded into an inner side of a doorframe and a second seat embedded at an upper edge of the doorframe. The first seat has a magnetic field seat which has a metal block therein. The metal block is retained with a plurality of lock studs which are arranged spacedly. One end of the lock stud is a heat protruded from a surface of a metal. The inner side of the second seat is assembled with a metal plate which is moveable as it is attracted. The metal plate faces to the first seat. The lateral side has two receiving grooves at positions corresponding to the two lock studs. A bottom of the receiving groove has a penetrating through hole. A buckling block is installed in the receiving groove. A buckling recess is formed in the buckling block facing to an opening of the lock stud. Two inner lateral walls of the buckling groove are inclined for matching to the lock studs. A screw penetrates through the bottom of the buckling groove of the buckling block and the through hole of the metal plate. A nut is fixed to a free end of the lock stud.

Although the prior art electromagnetic lock has the effect of locking, but the buckling groove of the buckling block in the second seat is buckled by the head of the lock stud and the buckling block is moved with the lock stud. When the doorframe is used for a long time, the buckling block will deform and the stud falls. The head of the lock stud is difficult to buckle the buckling groove of the buckling block so as to lose the function of locking.

SUMMARY OF THE INVENTION

Accordingly, the primary object of the present invention is to provide an electromagnetic lock comprises: a body combined with a retaining frame by using locking studs and retaining screws; one side of the retaining frame being installed with a trigger receiving box; and an absorption plate combined to a supporting frame; two metal rings being installed in the absorption plate; the absorption plate having locking screws; wherein in installation, for aligning the body and the absorption plate, adjusting screws are installed between the absorption plate and the supporting frame. The supporting frame has screw holes for receiving the adjusting screws; one side of the supporting frame has two magnetic holes for receiving magnets; a magnet protection sheet are installed at lower side of the magnets; a small screw serves to lock the protection sheet to the supporting frame.

Thus, in the present invention, the trigger can be hidden so as to occupy a small space and the installation work is easy. The rings of the absorption plate causes that the absorption plate can be aligned to the body easily. The adjusting screws between the absorption plate and the support frame is adhered with rubber washers and thus is helpful to the reduction of noise as the door is opened.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
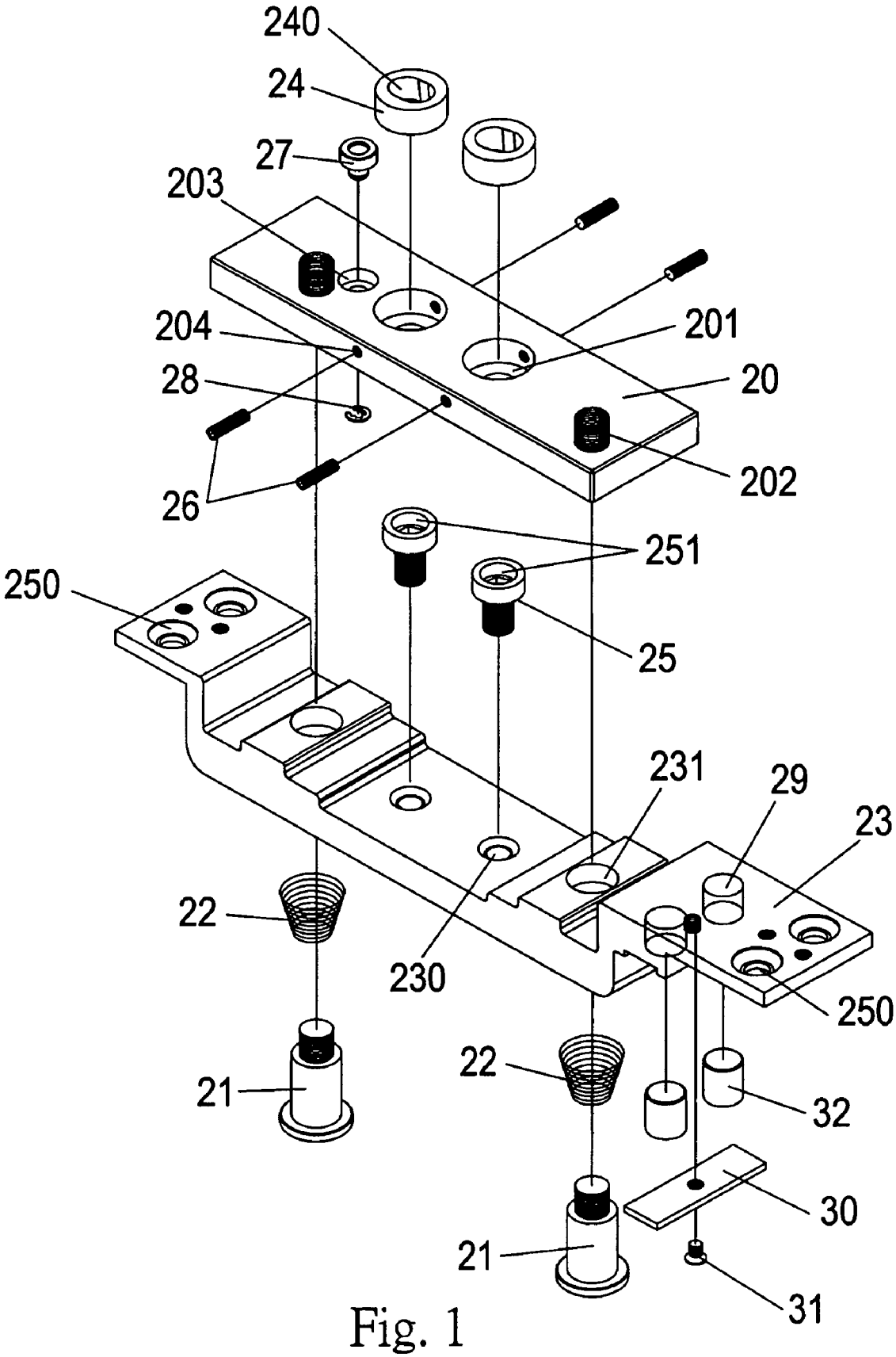
FIG. 1 is a schematic view of the present invention.
Figure 2:
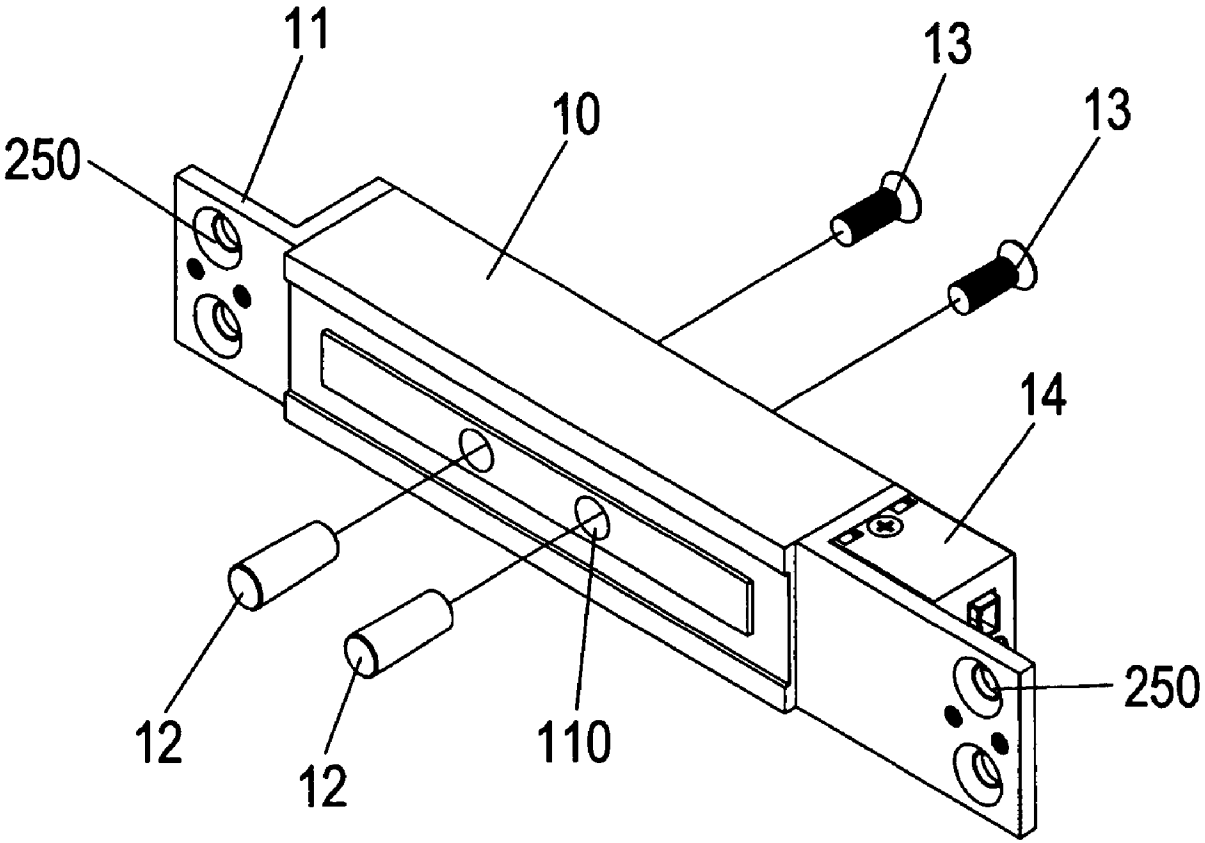
FIG. 2 is an exploded perspective view of the present invention.
Figure 3:
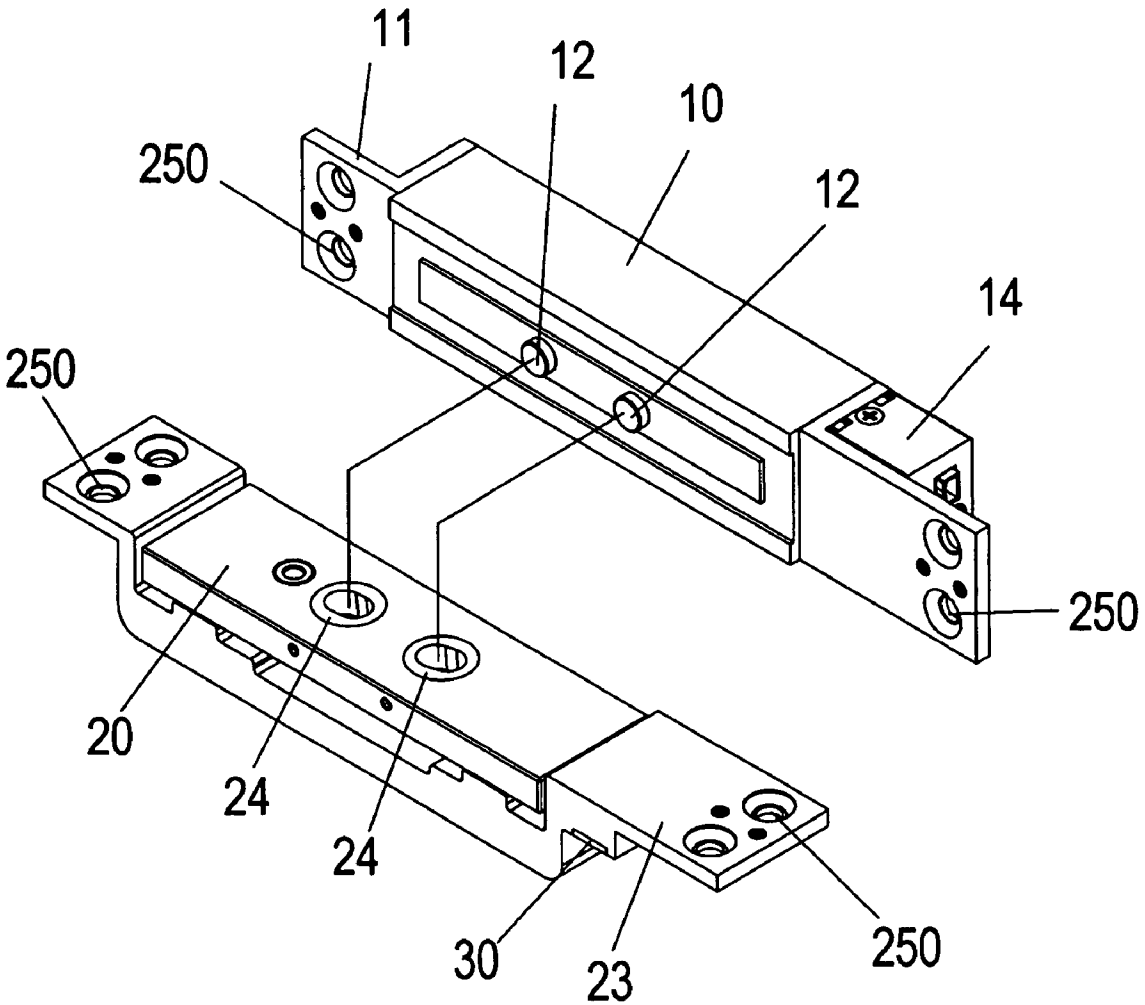
FIG. 3 is an exploded view of the absorption plate.

Referring to FIGS. 1, 2 and 3, the structure of the electromagnetic lock of the present invention has the following elements.

A body 10 is combined with a retaining frame 11 by using locking studs 12 and retaining screws 13. The body 10 has screw holes 110 for the combination of the locking studs 12 and the retaining screws 13.

One side of the retaining frame 11 is installed with a trigger receiving box 14.

An absorption plate 20 is combined to a supporting frame 23 by using locking screws 21 to engage with tapered springs 22. The absorption plate 20 is installed with through holes 201. Two metal rings 24 are installed in the through holes 201 of the absorption plate 20. The absorption plate 20 has two screw holes 202 for receiving the locking screws 21. The absorption plate 20 has a penetrating hole 203 for receiving a button 27 and an E shape buckle ring 28 which is engaged with the button 27. Each metal ring 24 has an elliptical hole 240.

In installation, for aligning the body 10 and the absorption plate 20, adjusting screws 25 are installed between the absorption plate 20 and the recess 230 of the supporting frame 23. An upper end of the adjusting screw 25 is adhered with a rubber washer 251 so as to reduce the noise due to the resilience of the absorption plate 20 as a door is opened. Furthermore, the trigger plate is hidden with less space and can be installed easily.

The supporting frame 23 has screw holes 230 for receiving the adjusting screws 25. One side of the supporting frame 23 has two magnetic holes 29 for receiving magnets 32. A magnet protection sheet 30 is installed at lower side of the magnets 32. A small screw 31 serves to lock the protection sheet 30 to the supporting frame 23.

Figure 4:
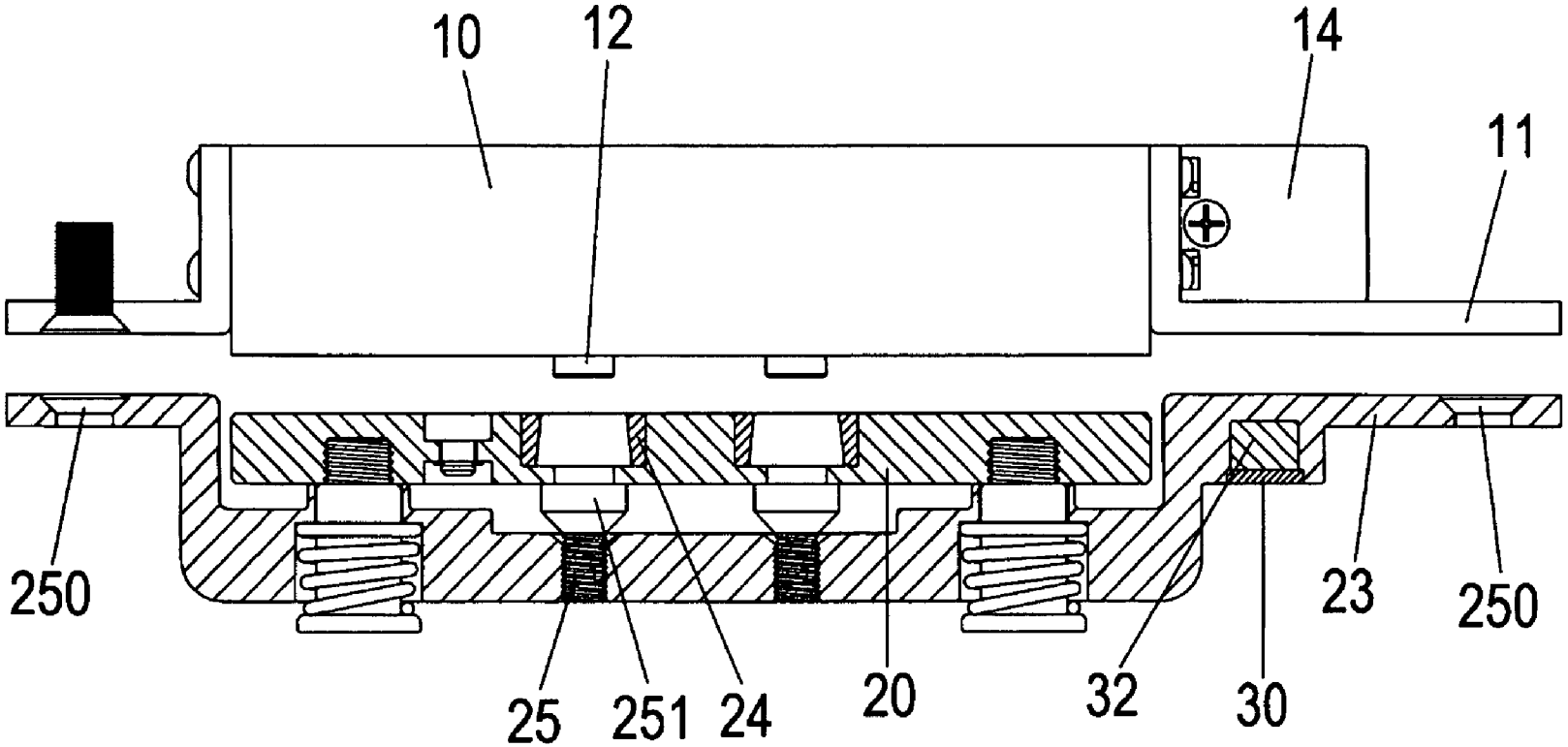
FIG. 4 is a schematic cross sectional view of the present invention.

Referring to FIGS. 2, 3 and 4, the combination of the locking studs 12 and the retaining screws 13 can protrude from the body 10. The locking studs 12 are exactly buckled to the metal rings 24 firmly. In installing the electromagnetic lock, the locking studs 12 are positioned by the metal rings 24 so that the body 10 can be aligned to the absorption plate 20. Moreover, the metal rings 24 has the properties of enhancing the structure and the wear proof so as to avoid the wearing of the locking studs 12 and the through holes 201 of the absorption plate 20, which will cause the vibration of the locking stud 12 and the absorption plate 20, even the function of locking is lost.

Figure 5:
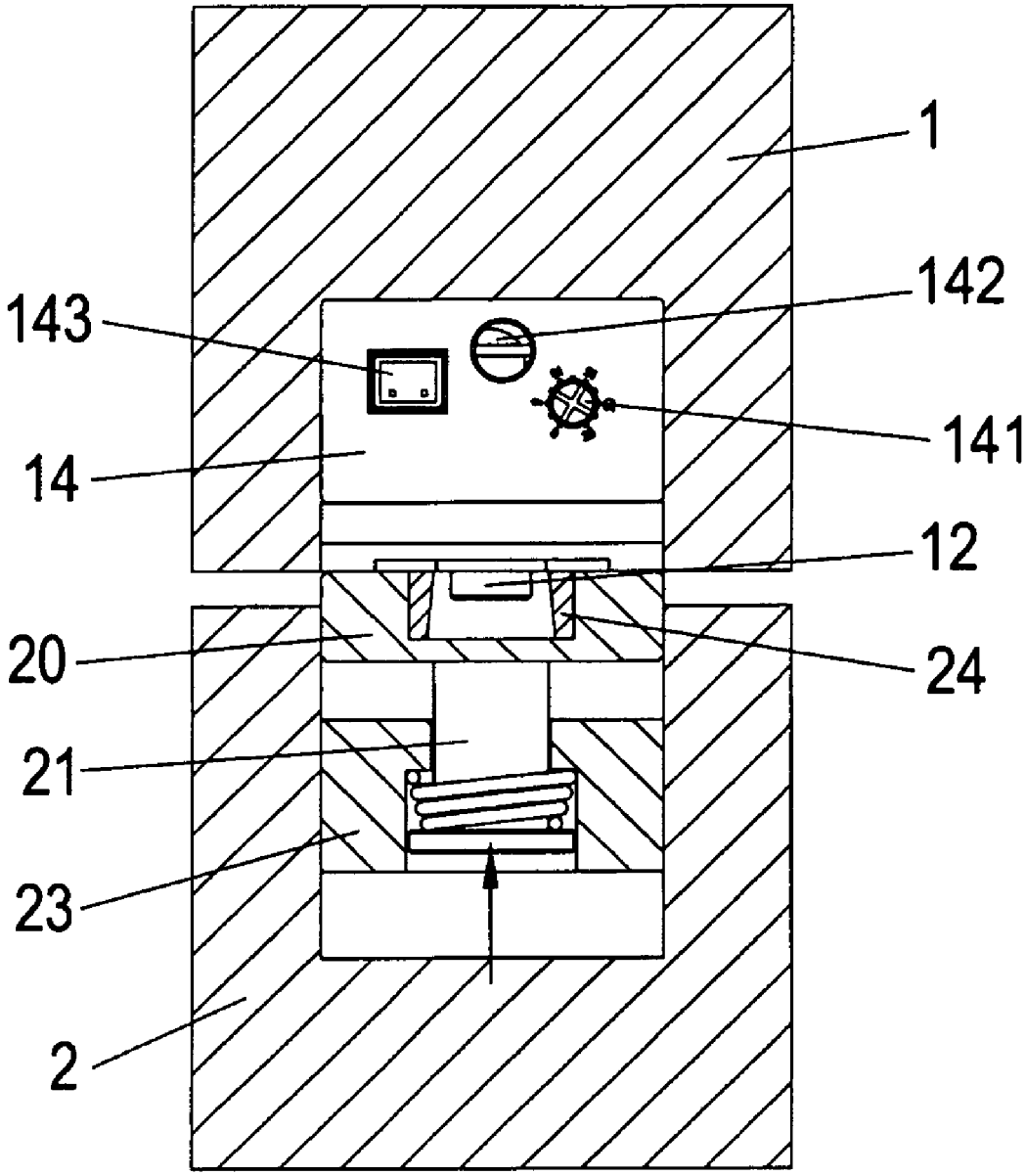
FIG. 5 is a lateral schematic view of the present invention.
Figure 6:
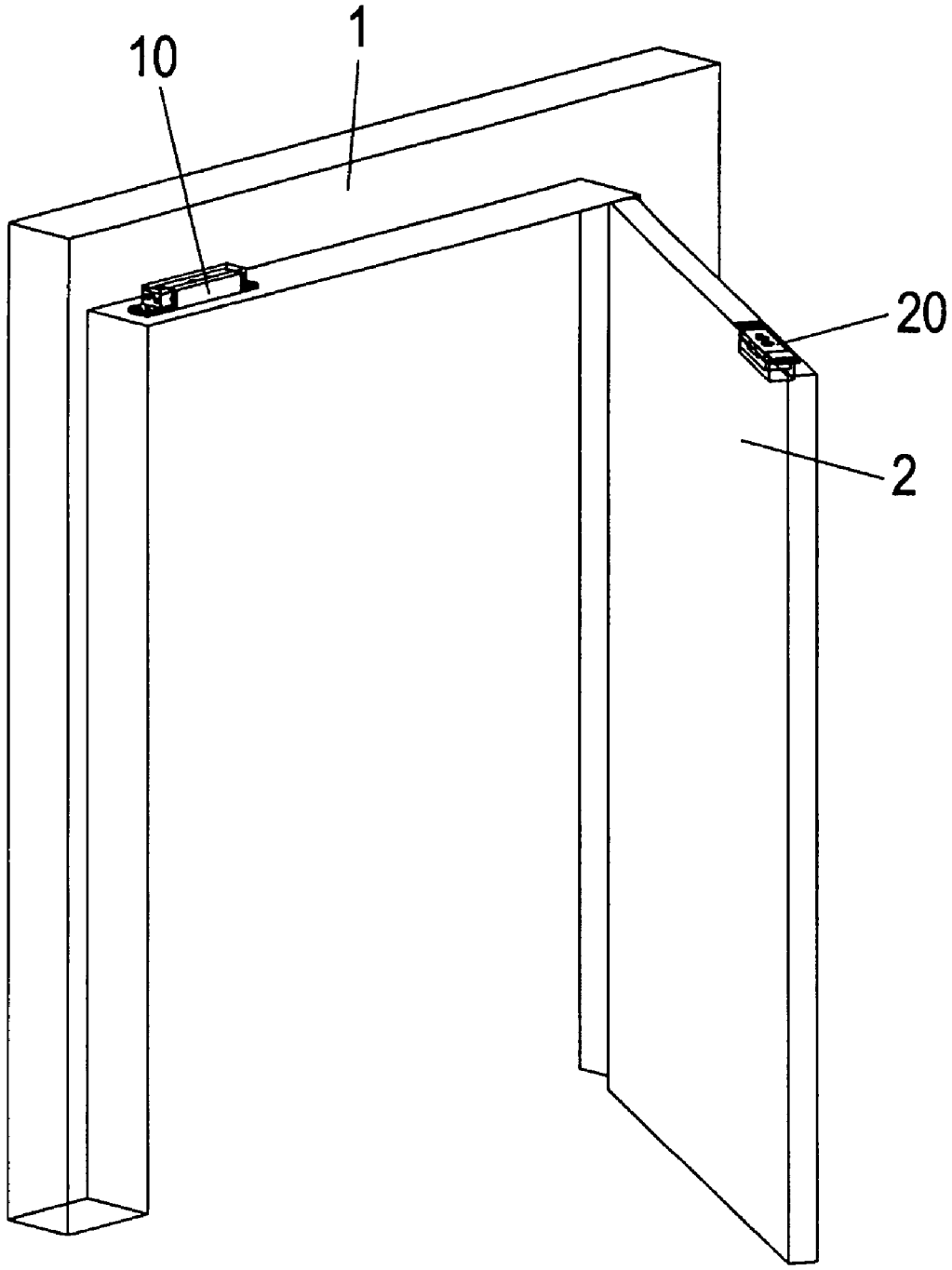
FIG. 6 shows that the present invention is assembled to a doorframe and a doorplate.

Referring to FIGS. 4, 5 and 6, the supporting frame 23 is installed with lock holes 250 for locking with the doorframe 1 and the doorplate 2. When releasing from locking state, by the adjusting screws 25 between the absorption plate 20 and the supporting frame 23, the upper rubber washers 251 upon the upper end of the adjusting screws 25 will reduce the noise from the resilient force of the absorption plate 20 due to opening of a door. One side of the retaining frame 11 is installed with a trigger receiving box 14 which is installed with a second counting button 141, a wire outlet 142, and a slot 143 for installing an external indicating light. Thus, the trigger is hidden with less space and can be installed conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromagnetic lock comprising:

a body for mounting in a door jamb, said body combined with a retaining frame by using locking studs and retaining screws; one side of the retaining frame being installed with a trigger receiving box at a position with respect to a magnet; and an absorption plate for mounting in a door, said absorption plate combined to a supporting frame; two metal rings being installed in the absorption plate; the absorption plate having locking screws for locking the metal rings to the absorption plate; and wherein in installation, for aligning the body and the absorption plate, adjusting screws are installed between the absorption plate and the supporting frame; and wherein the supporting frame has screw holes for receiving the adjusting screws; one side of the supporting frame has two magnetic holes for receiving magnets; a magnet protection sheet are installed at lower side of the magnets; and a small screw serves to lock the protection sheet to the supporting frame; wherein said body and said absorption plate are capable of being locked together by magnetic attraction.

2. The electromagnetic lock as claimed in claim 1, wherein each metal ring has an elliptical hole.

3. The electromagnetic lock as claimed in claim 1, wherein an upper side of each adjusting screw is adhered with a rubber washer.

4. The electromagnetic lock as claimed in claim 1, wherein the body has screw holes for the combination of the locking studs and the retaining screws.

5. The electromagnetic lock as claimed in claim 1, wherein the absorption plate is installed with through holes; the two metal rings are installed in the through holes of the absorption plate; the absorption plate has two screw holes for receiving the locking screws; the absorption plate has a penetrating hole for receiving a button and an E shape buckle ring which is engaged with the button; and each metal ring has an elliptical hole.

6. The electromagnetic lock as claimed in claim 1, wherein the combination of the locking studs and the retaining screws protrude from the body.

7. The electromagnetic lock as claimed in claim 1, wherein the supporting frame is installed with lock holes for locking with the doorframe and the doorplate.

8. The electromagnetic lock as claimed in claim 1, wherein one side of the retaining frame is installed with the trigger receiving box which is installed with a counting button, a wire outlet, and a slot for installing an external indicating light.

* * * * *